US005797238A

United States Patent [19]

Berntsson et al.

[11] Patent Number: 5,797,238

[45] Date of Patent: Aug. 25, 1998

[54] METHOD OF PRODUCING CONCRETE STRUCTURES WITH A SURFACE PROTECTION AND A CONCRETE STRUCTURE PRODUCED IN ACCORDANCE WITH THE METHOD

[75] Inventors: Leif Berntsson; Bengt Hedberg, both of Göteborg, Sweden

[73] Assignee: Delcon AB Concrete Development, Sweden

[21] Appl. No.: 569,080

[22] PCT Filed: Jun. 9, 1994

[86] PCT No.: PCT/SE94/00558

§ 371 Date: Dec. 18, 1995

§ 102(e) Date: Dec. 18, 1995

[87] PCT Pub. No.: WO95/00305

PCT Pub. Date: Jan. 5, 1995

[30] Foreign Application Priority Data

Jun. 18, 1993 [SE] Sweden ..... 9302118

[51] Int. Cl.[6] ..... E04B 1/14; E04C 1/40; E04C 2/04

[52] U.S. Cl. ..... 52/612; 52/223.6; 52/745.05; 264/228; 264/256

[58] Field of Search ..... 52/223.6, 612, 52/745.05, 745.19; 264/228, 256

[56] References Cited

U.S. PATENT DOCUMENTS

| | | | |
|---|---|---|---|
| 1,889,745 | 12/1932 | Chapman | 52/612 |
| 2,038,967 | 4/1936 | Strong . | |
| 2,310,432 | 2/1943 | Haux | 52/612 X |
| 3,286,418 | 11/1966 | Radford . | |
| 3,637,457 | 1/1972 | Gothard et al. | 264/228 X |
| 4,049,874 | 9/1977 | Aoyama et al. | 52/612 X |
| 4,185,431 | 1/1980 | Brownlee | 52/612 X |
| 4,513,040 | 4/1985 | Lankard | 52/612 X |
| 4,774,045 | 9/1988 | Kushida et al. | 264/256 |
| 4,831,802 | 5/1989 | Cromrich et al. | 52/612 X |
| 4,955,171 | 9/1990 | Kossatz et al. | 52/612 |
| 4,981,626 | 1/1991 | Uchizaki | 264/256 X |

FOREIGN PATENT DOCUMENTS

| | | | |
|---|---|---|---|
| 163039 | 5/1949 | Austria | 52/612 |
| 1452197 | 9/1966 | France . | |
| 302911 | 1/1968 | Sweden . | |
| 321178 | 2/1970 | Sweden . | |
| 368599 | 7/1974 | Sweden . | |
| 431419 | 2/1984 | Sweden . | |
| 369322 | 3/1932 | United Kingdom | 52/612 |

*Primary Examiner*—Carl D. Friedman
*Assistant Examiner*—Kevin D. Wilkens
*Attorney, Agent, or Firm*—D. Peter Hochberg

[57] ABSTRACT

Method of producing concrete structures with a surface protection layer and a concrete layer. The method includes moulding the concrete layer and the surface protection layer using a "wet in wet" process. The surface protection layer preferably consists of a cement allied mortar having a low water binding average ratio and a binding agent strength above 70 Mpa. The concrete layer which preferably consists of a concrete having a lower binding agent strength than the surface protection layer, is preferably an air entrained ballast concrete with dense structure and a strength in the range of 10–20 Mpa. The surface protection layer is cast in the bottom of a mold, and the concrete layer is cast above the surface protection layer. During desiccation of the material, the surface protection layer shrinks less than the concrete layer, so that pressure strains are created through deformation differences in the surface protection layer and concrete layer.

5 Claims, 1 Drawing Sheet

METHOD OF PRODUCING CONCRETE STRUCTURES WITH A SURFACE PROTECTION AND A CONCRETE STRUCTURE PRODUCED IN ACCORDANCE WITH THE METHOD

The present invention refers to a method of producing concrete structures with a surface protection on the underlying concrete, by casting the latter and at least a surface layer substantially "wet in wet", as well as a concrete structure with a surface protection in form of a surface layer, which is integrated with the underlying concrete by having the latter and the surface layer made substantially through a "wet in wet"-process.

BACKGROUND OF THE INVENTION

Concrete structure surfaces and surface layers have a significant importance for the technical lifespan of the structure. They completely determine the look or, in other words, are essential for the aesthetic quality of the concrete structures. Other technical characteristics that are bound to surface are wearing qualities, resistance against high point loads and impact resistance. For outdoor structures, the characteristics relate to those surfaces that are broken down by frost influence, erosion and chemical attack.

It is a common procedure to protect a material through some type of surface treatment. Steel and wood are examples of such materials, which permanently and initially, need to be provided with surface protection. Concrete however is not seen as needing to be protected. The philosophy is that concrete, right from the beginning, must be resistant enough against those influences to which the structure is exposed too. One composes concrete during proportioning so that set conditions are fulfilled. This is controlled during pretesting. The requirements are based on the understanding that a concrete structure has to be given a determined technical life span, for example 100 years. It is well known that it is quite difficult to succeed with the casting of concrete layers, and in particular such thin ones, on an already hardened and aged concrete. Differences in deformation process such as shrinkage and evolution of the adherence between the underlying concrete and the surface layer are probable causes of bad results.

The ground to concrete structures life-span lies in the protection of the reinforcement. The concrete that covers the reinforcement constitutes, as it is well known, the corrosion protection. The choice of concrete is guided almost exclusively by the characteristics that are required for the concrete to provide satisfactory reinforcement protection. The strength requirement for the structures, which are produced with present standards is about to be automatically fulfilled. The concrete is provided with a strength, which in some cases widely exceeds what is needed for the carrying capacity. With present production techniques, one is forced to choose the same high quality concrete throughout a whole concrete structure even if it is only in the surface layer that the highest set requirements are required.

Through SE-B-368 599, a procedure for producing building plates of light concrete with a front layer of normal concrete is already known, where the light concrete layer, which has a bulk density of 625 kg/m$^3$, is exposed to a low pressure so that the excess water is sucked out before the front layer is mounted. The low pressure treatment has the purpose to prevent shrinkage during the hardening and to let the tensions appearing between the layers remain therefore slight.

Through the Swedish publication 302 911, a procedure for producing building blocks and plates with a resistant surface layer is also known. This consists of many layer parts, a part nearest the normal concrete comprising decomposed mineral/glass-fibre particles and larger grains of cement, cinder and sand and that intermediate layer forms an efficient filter mat, which only lets those very smallest particles of the components cement, cinder and sand, slip through, said components building the layer part located nearest to the casting mould. Both surface layer parts are left to be bound, which can be done under vacuum or heat, so that at least a partly bound bottom layer has been obtained before normal concrete is poured over the surface layer. Since the surface layer must be of low viscosity, it is probably a necessity to achieve a stabilization of the bottom layer, i.e. until it starts binding, which usually happens within 1–3 hours. A firm consistency is required for the normal concrete during its casting over the surface layer to avoid forcing its way through or pushing it out. Since the density in the different layers is rather like each other, no big stress under compression arises in these layers.

SE-B-321 178 describes a method to produce building elements with different density in different cross section parts using the same binding agent. According to this publication, porous light concrete elements with a dense front surface are produced by placing in a casting mould against the mould surface slices of asbestos fibres and binding agent that are partly steam hardened and that space behind the slices is filled with a pore building light concrete mass. After the light concrete has bound up and solidified in the mould, it is steam hardened in an autoclave at a temperature that is higher than 150° C. The production of pre-prepared slices as well as the autoclave processing of the entire building block make the manufacture more expensive and make the procedure applicable only to prefabrication.

According to U.S. Pat. No. 3,286,418, composite concrete plates are produced, where the surface layers are solidified at an increased temperature before the central core of light concrete is poured. To achieve a better transition between the surface layer and the central core, the contact surface is coated with an adhesive polish. No type of stress under compression is produced between the different layers.

The progress of concrete technology during the last two decades has enabled an appreciable widening of concrete use. There is hardly any material, which can be provided in as large a width as concrete. Compression strengths of 3–300 Mpa and densities of 300–3000 kg/m$^3$ can exemplify this assertion. On top of that, development of reinforcement using fibre techniques and modification with polymers is in progess. The binding agent of Portland cement can even be entirely changed to polymers.

SUMMARY OF THE INVENTION

The object of the invention is to produce different types of surface layers on concrete during manufacturing. The surface layers shall have the possibility to completely cooperate with the underlying concrete, shall reinforce the protection of structures in various enviromental conditions, which have changed with time, shall in special cases be able to reduce the requirement on the covering concrete layer, and shall as extra protection further improve the durability in important structure parts even in an extremely aggressive environment. This has been achieved through a method of producing concrete structures with a surface protection on the underlying concrete, by casting it and at least a surface layer substantially "wet in wet".

Figure 1:
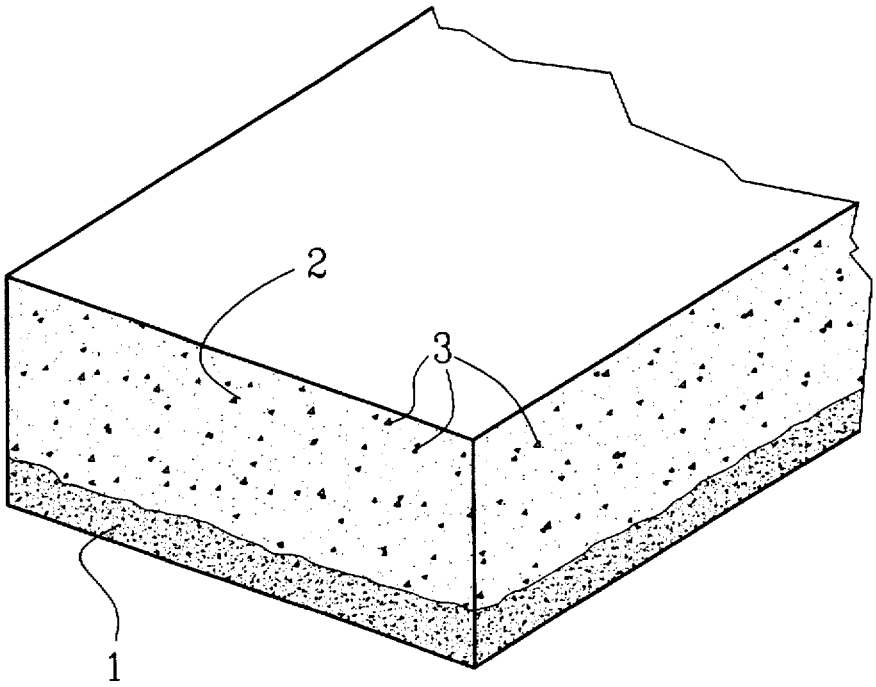
FIG. 1 is a partial perspective view of a concrete structure according to the invention having a surface layer and a concrete layer.

The invention is based consequently on giving rise to pressure strains in the surface layer in concrete structures. These pressure strains are created by deformation differences in the surface layer and the underlying concrete. The deformations are caused by shrinkage and drying shrinkage that arise after the hardening. The end shrinkage can be regarded as being reached when a moisture balance has been set with the surrounding. The prerequisite is consequently that the surface layer and the underlying concrete material have different shrinkage magnitude and that the shrinkage of the surface layer is smaller than the underlying concrete. This can generally be fulfilled when the surface layer is made of mortar or concrete with high strengths or of other material, which does not have after-shrinkage and if the underlying concrete is of the lightweight type. Lightweight concrete has a low elastic modulus and therefore gives a limited obstacle for the shrinkage. It is a necessary condition that the so-called relaxations that are generated between the surface layer and the existing underlying concrete must be able to be carried out without the separating of the surface layer. This problem can be solved by resorting to particular actions in the transition zone associated with the casting.

Surface layers and concrete cast "wet in wet" will eventually generate pressure strains in the surface layer due to the influence of differences in drying shrinkage between the surface material and the underlying concrete. To get pressure strains in the surface layer that is aimed at, it is required that the surface material have a smaller shrinkage than the underlying concrete. Pulling strains appear at the same time in the underlying concrete. The magnitude of the tensions is determined by both the elastic modulus of the mat and the thickness of the surface layer.

The pressure strains in the surface layer are approximately 10–15 Mpa and pulling strains in the underlying concrete 1/10 thereof. One can roughly come up to this under the condition that one supposes that bending of the underlying concrete does not occur, that the shrinkage is approximately twice as big in the underlying concrete, that the elastic modulus in the underlying concrete is 1/5–1/7 of the one in the surface layer and that the operative thickness in the underlying concrete is about 10 times as large the surface layer. If the bending is taken into consideration, all tensions are reduced as the constraint is reduced. The maximum pressure strain in the surface layer is reduced with some more than 20% and the maximum pulling strain in the underlying concrete with less than 10%. The biggest deflection is approximately 1/400 of the span when this one is 1.2 m.

Within the surface layer, the shrinkage strains will have a different magnitude. The difference is caused by the separation of the aggregate particles so that different aggregate volume shares arise within the layer, with a low percentage in the upper part. When the volume percentage is reduced from 0.7 to 0.35, i.e. halved, the shrinkage increases about four times. The calculation is done using Pickett's formula, which follows: $\epsilon=\epsilon_p\cdot(1-g)^m$, where $\epsilon p$ is the shrinkage of the water-cement paste, g is the aggregate volume share and m=1.7 for quartz material and the like. The results can then be that the less shrinking operative thickness of the surface layer becomes thinner, the pressure strains bigger and the bending smaller. Through intentionally raised sedimentation of aggregate particles in the surface layer, a successive increase of the shrinkage and a reduction of the pressure strains in the direction of the underlying concrete appear.

The most important thing to avoid on one hand is a pulling strength in the mortar stage that is exceeded in the surface layer, and on the other hand to facilitate that already built cracks get a reduced crack width or even the possibility to be closed. Lightweight concrete elastic modulus is 6000–7000 Mpa and its shrinkage (end shrinkage) at 50% relative air humidity is at least 0.9%.

There are several reasons to produce pressure in the outer layer on a material and in particular a brittle material like concrete. A direct parallel is the effect of hardening on glass, which also is a brittle material. Defects in the surface such as scratches or microcracks are quite decisive for the material to break through the very high strains that arise in the crack ends and the strength with regard to the outer stress. The hardening process gives pressure strains in the glass surface layer. One counteracts the pulling strains and diminishes the risk that so-called brittle break occurs.

In concrete material, the strains in the surface layer will not become as big as in a glass surface layer where strains of up to 140 Mpa can arise after the hardening. The goal is however not the same with concrete material even if similarities are found. For concrete structures, the following discussed below can be achieved with thin surface layers.

Common requirements that are generally found and can be set on surfaces are the following:

Good resistance against attack from the surrounding environment.

Good chemical resistance.

Resistance capacity against temperature differences and temperature shocks.

Good wearing qualities.

Pore and crack-free surfaces.

Flexibility in colour and structure.

Technical effects: High strength in general, good resistance against physical/chemical influence, such as salt-frost bursting, high wearing qualities, great resistance against impact and high point loads, fulfilling of high sanitary requirements, great resistance against acid attack and salt influence and low permeability with regard to chlorides and carbon dioxide are usual characteristics that nowadays are actual for concrete structures.

Aesthetic effects: Great freedom to colour surfaces with long durability, among others by pigment inking, good possibilities to create surface structures, such as reliefs, smooth and even surfaces with possibly high lustre (without grinding) and, in the manufacturing process, to create flexible surfaces with the mosaic technique.

A material that is particularly adapted to combination is, for surface layers, cement bound mortar with low water binding agent ratio, equivalent to a binding agent strength in general over 70 Mpa. As underlying concrete, lightweight concrete with dense structure has appeared particularly appropriate, for example the lightweight concrete with a density in the range 800–1500 kg/m$^3$ mentioned in SE-B-8305474-2. This concrete type is a structure concrete with approximately half the density of normal concrete, strengthen in the area 10–20 Mpa, contains high air entrained volume in cement paste, has hydrophobic characteristics and is open for diffusion with regard to water vapour. Drying shrinkage is further about three times bigger than for the high-test concrete with particular high strength, which can be chosen for the surface layer. It is possible to use concrete types with usual heavy aggregate material as the underlying concrete with a density of about 2300 kg/m$^3$.

Materials other than the cement bounded type can be chosen, for example thermosetting resin such as epoxy and urethane as well as combinations between polymers and cement. These are of the type that corresponds to modified polymer concrete in which hydraulic binding agents cooperate with polymer dispersions, for example based on acrylic and styrene butadiene.

The surface layer, consisting of merely thermosetting resin, should be chosen with little thickness, from 100 μm to 1–2 mm. The advantage of fixing the polymer layer in connection with the concrete casting is that the polymer becomes completely tight. Pore formation that frequently for channels in polymer layer occurs when the layer is applied on hardened concrete surfaces. Polymer types must be compatible with non hardened concrete.

The hydraulic binding agent is based partly on Portland cement, which can be regarded as calcium silicate-cement and partly on calcium aluminate-cement. Particularly with Portland cement, different agents and supplemental material are added to change the characteristics in both the fresh and the hardened material. In the modern concrete there is foremost the binding agent, which has changed by means of combinations of additive and supplemental material. Additives are compounds when used in a small amount can change the chemical and physical characteristics. To these additives belong ,for example, dispersing, also referred to a wetting and water reducing, accelerating, retarding air pore creation, tightening and hydrophobing. Supplemental material are those materials, which cooperates with Portland cement as a binding agent, such as puzzoluna (microsilica and fly ash) and latent hydraulic binding agent (granulated slag).

Instead of cement paste with low water-cement ratio and providing little drying shrinking after a longer drying period one can use expansive Portland cement in the upper layer. This type of cement provides swelling in hardened condition during the first 14 days by supplying extra water on the surface. In that way compressive stress is built up in the upper layer even during the first curing time before drying out is developed. The objective is achieved regardless of drying out or when the drying out can occur, and compressive stress is caused in the top layer. Swelling was achieved in these cement types by establishing ettringit (a mineral created under swelling conditions) during the hydration process or similar hydrations products. The size of expansion is regulated by adding expansive cement or expanding component admixture to Portland cement. There are even other system, which can develop swelling together with Portland cement such as admixtures of gypsum in greater amount.

Because the surface layer has relatively little thickness the particle size of the aggregate material is limited. Maximum aggregate size should not outreach half the thickness of the layer. If the largest aggregate size is 2 mm the thickness of the layer as a rule should be at least 4 mm. The minerals or the kind of rocks that is suitable for the surface layer is the same as normally used in usual concrete, with same demand with regard to for example durability, strength and wear resistance. For the surface layer it is important that the colour of the aggregates cooperates with the colour, which the surface layer shall have. Normally the aggregates shall be light when the surface layer shall have light nuance. Pigment added to the binding agent and thereto adapted aggregate material enables big variation in the colour of the surface layer.

The structure of the surface layer is determined by the form material. The casting becomes a copy of the surface of the form. When using most of the form material for concrete casting the form material must be covered by some type of release agent, i.e., form oil. In many cases the form oil has negative impact on the concrete surface, such as discolouration and a problem in connection with later surface treatment. The polymer modified binding agent and the particular layer of thermosetting plastics demand a special release agent. The choice of form material in these cases is important. A general requirement is to avoid all forms of form oils, which can influence the surfaces.

At the production of building unit conventional concrete casting technique is used. The surface layer is moulded in a lying form and is vibrated, e.g. by form vibrators, to compress the material, to obtain an even thickness as well as to drive out eventual air-bubbles. By the layer thickness being small, one obtains entirely pore free surfaces. Underlying concrete, for example light concrete, is suitably moulded immediately after that the surface layer laying is finished.

The surface layer and the underlying concrete can also be reinforced with conventional material, for example fibre reinforcement and the usual reinforcement in the underlying concrete. During the casting of the under concrete layer, a problem with penetration of the underlying concrete through vibrating can arise, specially at barrel surface layer. When the concrete material, which is chosen as underlying concrete has approximately half of the density of the surface layer material, the penetration is avoided. Further, extra fibres can be scattered on the newly moulded surface layer, which both reinforces and constitutes the carrying surface for the weight, which is applied from conventional reinforcement without using a distance spacer to ensure a determined coat layer thickness. Distance models provide visible marks on the surface and risk making a leak arise.

The surface layer is a compound meeting the valid requirement, for example durable surface, which resists high concentrated loads. The surface can also be given a determined colour. By using so-called super wetting agents, mortar with very loose consistency and with the ability to float out during the casting can be obtained. The ballast particles in the mortar can be allowed to separate so that the volume share of particles in the bottom are higher than the average for the layer. This is advantageous for surface hardness and durability. The top of the layer instead becomes generally devoid of ballast particles. This separation layer, which mainly consists of paste, gives a successive transfer to the top concrete without a sharp border between the two materials. The tension gradients in the transition thereby become smaller. In extreme cases, this layer can be a blocking layer increasing the impact resistance by energy absorption and energy distribution. A double layer can be moulded in such a case and will reinforce the effect of the middle layer and increase the resistance to blows and impacts. Some type of polymer dispersion can be added in the first mortar layer or fibre in the blocking layer. The same basic technique is the basis for the structure of bulletproof glass.

The surface layer, where particular requirements exist for fire resistance, should have as little steam resistance as possible, to avoid steam explosion and early splitting of the surface layer. Air pore builder in the mortar, open the ballast material by gas or cavity mortar, i.e. mortar with deficit of cement paste can be a possible solution when dense surface layer must be avoided.

Referring to FIG. 1, a concrete structure according to the invention is shown. The structure comprises a surface layer 1 and a concrete layer 2. Layer 1 is cast on the bottom of a mould, and has a binding strength of at least 70 MPa. Layer 2 is cast above layer 1 in the mould, and has a dense structure. Layer 2 preferably is comprised of air entrained ballast 3 with a strength of 10–20 MPa.

Examples of material and compound for mortar in the surface layer are as follows:

1. Portland cement: sand. $d_{max}$=2 mm. (per weight)=1:1–5 water+air-cement ratio=0.2–0.5 wetting agent/floating agent (naphthalene, melamine, acrylic or lignosulphonate based) 0.2–4% of cement amount.

| | | |
|---|---|---|
| 2. | Portland cement | 1.0 (per weight) |
| | microsilica | 0.05–0.40 (per weight) |
| | sand | 1–5 (per weight) |
| | floating agent | 1.5–4% of cement amount |
| | water binding average value | 0.25–0.5 |
| 3. | Portland cement | 0.2–0.8 (per weight) |
| | grounded granulated cinder | 0.8–0.2 (per weight) |
| | sand | 1–5 (per weight) |
| | floating agent | 0.5–2% of cement amount |
| | water binding average value | 0.25–0.5 |
| 4. | Portland cement | 0.60–0.95 (per weight) |
| | fly ash | 0.40–0.05 (per weight) |
| | sand | 1–5 (per weight) |
| | floating agent | 1.5–3% of cement amount |
| | water binding average value | 0.25–0.5 |

5. The above, in combination with microsilica and fly ash, among themselves having all mutual contents possible. Other types of pozzolana such as trass or Santorini soil (a soil or earth which is a volcanic tuff coming from the Greek island of Santorini) can also be used.

6. The above, with colour pigment from 0.05–0.25 weight percent of cement amount or cinder amount. For light colors white Portland cement and white microsilica should be chosen. Generally, cinder gives light mortar and can therefore be included without problem to obtain light colors. Some agents can cause colour changes, such as naphthalene and lignosulphonate types.

7. Ballast material with other densities than normal quartz. The amount is converted to corresponding volumes without other changes in the compound.

8. Polymer dispersions are added to the recipe examples 1–7 with a polymer amount that corresponds to 2–15% of the weight binding agent.

9. Grounded granulated cinder, which activates with alkalis, sulphate lime etc. can constitute the binding agent, specially the increased chemical resistance (acid attack) and block against penetration of chloride is intended to be achieved.

Examples of surface layer of polymers or thermosetting plastics are epoxy, urethane and polyester. To combine these with fresh concrete, which consequently has not hardened, the same principles should be valid for the function, namely that the surface layer should have full adhesion in the mortar state against the concrete and that pressure tensions are developed. Since shrinkage of the polymer layer above all is bound to the polymerization, the shrinking in later phase is insignificant. Furthermore, epoxy has hardly any shrinkage at the polymerization unlike, for example polyester types.

Examples of the air entrained ballast concrete is found documented in SE-B-8305474 (publication number: 453 181).

Practical samples of the concrete structures produced according to the invention have shown that a complete cooperation between the surface layer and the underlying concrete is obtained. The surface layer of the concrete surface was porous and crack free and exhibited good resistance capacity against temperature differences and temperature shocks.

The invention has been described in detail with particular emphasis being placed on the preferred embodiment, but modifications and variations within the spirit and scope of the invention may occur to those skilled in the art to which the invention pertains.

We claim:

1. A concrete structure comprising:

a surface layer comprised of cement allied mortar with a low water binding average ratio and a binding agent strength of at least 70 Mpa, and of separated ballast particles; and a concrete layer above the surface layer, said concrete layer being comprised of a concrete layer having a lower binding agent strength than the surface layer, said strength being approximately 10 to 20 Mpa, said concrete layer having an air-entrained ballast and having a dense structure;

wherein a part of said surface layer adjacent to said concrete has a lower volume percent of ballast than the part of said surface layer facing away from said concrete layer.

2. A concrete structure as defined in claim 1, wherein the surface layer has a desiccation shrinkage that is less than desiccation shrinkage of the concrete layer, whereby pressure strains through deformation differences are built in the surface layer and the concrete layer.

3. A method for producing a concrete structure having a surface layer and a concrete layer, said method comprising:

casting the surface layer in the bottom of a mould, said surface layer being comprised of cement allied mortar with a low water binding average ratio and a binding agent strength of at least 70 Mpa;

casting the concrete layer in the mould above said surface layer, said concrete layer being comprised of an air entrained concrete having a lower binding agent strength than the surface layer, said strength being approximately 10 to 20 Mpa and said concrete layer having a dense structure;

desiccating the surface layer and the concrete layer, wherein said surface layer shrinks less than the concrete layer to create pressure strains through deformation differences between the surface layer and the concrete layer and separating ballast particles in said surface layer to render a part of said surface layer adjacent to said concrete layer to have a lower volume percent ballast than the part of said surface layer adjacent to the mould.

4. A method as defined in claim 3, wherein a blockage layer is arranged between said surface layer and said concrete layer, wherein said blockage layer is comprised of the same general compound as said surface layer.

5. A method as defined in claim 3, herein desiccation shrinkage of the concrete layer is approximately twice as large as desiccation shrinkage of the surface layer.

* * * * *